United States Patent [19]

Hackworth et al.

[11] Patent Number: 4,779,070

[45] Date of Patent: Oct. 18, 1988

[54] HIGH ENERGY TOROIDAL INDUCTOR

[75] Inventors: Donald T. Hackworth, Monroeville; Daniel W. Deis, Churchill Boro; David Marschik, Wilkins Township, Allegheny County; Henry R. Schwenk, Murrysville Boro; Edward J. Shestak, Penn Hills Township, Allegheny County; Carl J. Heyne, Hampton Township, Allegheny County; Henry Riemersma, Penn Hills Township, Allegheny County, all of Pa.

[73] Assignee: Westinghouse Electric Corp., Pittsburgh, Pa.

[21] Appl. No.: 943,231

[22] Filed: Dec. 18, 1986

[51] Int. Cl.[4] ..... H01F 7/00

[52] U.S. Cl. ..... 335/296; 335/299; 336/228

[58] Field of Search ..... 335/296, 299; 336/225, 336/228, 229, 232

[56] References Cited

U.S. PATENT DOCUMENTS

| | | | |
|---|---|---|---|
| 4,475,096 | 10/1984 | Sestero | 336/228 X |
| 4,664,867 | 5/1987 | Kuno et al. | 335/299 X |
| 4,664,868 | 5/1987 | Kuno et al. | 335/299 |

*Primary Examiner*—George Harris
*Attorney, Agent, or Firm*—D. Schron

[57] ABSTRACT

An inductor with high inductance to resistance ratio capable of handling megamp currents. Sixteen coil assemblies are radially arranged into four quadrants of four coil assemblies each and jumpers are utilized to connect the quadrants in different configurations for different inductance values. Each coil assembly is made up of a plurality of nested essentially D-shaped copper conductors collectively nested within an aluminum structural support plate in which eddy currents are minimized by a interruption in the plate. The individual conductors of each coil assembly are transposed throughout a quadrant for balanced current flow. Coil bus bars as well as an input and output bus bar are connected to predetermined ones of the coil assemblies with the input and output bus bars being connected to system input and output leads. The unit is operated at cryogenic temperatures by immersion in a liquid nitrogen filled cryostat.

36 Claims, 13 Drawing Sheets

HIGH ENERGY TOROIDAL INDUCTOR

STATEMENT OF GOVERNMENT INTEREST

The Government has rights in this invention pursuant to Contract F08635-84-C-0331 with the Department of Defense.

BACKGROUND OF THE INVENTION

1. Field of the Invention:

The invention in general relates to inductors, and particularly to those having extremely large structures capable of handling ultra-high currents.

2. Description of the Prior Art:

High energy inductors are utilized in a variety of pulsed power applications wherein the inductor is utilized as an intermediate pulse compression device. By way of example, relatively large inductors for magnetic energy storage for pulse power find application in the field of electromagnetic launchers which require pulsed power supplies capable of providing megampere currents at kilovolt levels for times of several milliseconds. This current level is needed in order to launch a projectile along parallel conducting rails such that the projectile has an exit velocity of many kilometers per second.

For some applications, inductors made with superconducting coils may be utilized under conditions where volume and space constraints are of no concern. The short energy storage times typical in the electromagnetic launcher system, however, would allow the use of non-superconducting technology without severe energy loss penalties. Additionally, the megamp current requirements for the electromagnetic launcher make the use of superconducting coils less attractive.

The requirements of a typical electromagnetic launcher system dictate that stray magnetic fields be limited, and accordingly use is made of toroidal coil geometries. One typical inductor which meets this requirement is fabricated from a plurality of rugged copper coils constructed of solid copper plates arranged in a circular array. The relatively simple and rugged construction of such inductor insures that it holds up well under repeated mechanical stress generated with pulse power applications, however, the efficiency is somewhat limited due to the current concentrations near the magnetic bore which tend to increase the effective resistance of the unit and thereby decrease its efficiency. Additionally, only a single inductance value is possible with such construction.

The inductor of the present invention exhibits relatively high efficiency and is capable of repeatedly carrying high currents in the order of millions of amperes. The inductor is of toroidal design to minimize external fields and is capable of being connected in two different inductance value configurations.

SUMMARY OF THE INVENTION

A high energy, low resistance inductor in accordance with the present invention includes a plurality of coil assemblies each including a group of nested conductors, the conductors preferably being essentially D-shaped. The nested conductors are contained within a central shaped aperture of a structural plate and a plurality of coil assemblies are radially arranged with respect to a central longitudinal axis. Means are provided for making electrical connections with and between the conductors of the respective coil assemblies.

In a preferred embodiment, the assemblies are divided into four different quadrants each having an input and output and a series of different connecting bus bars to the various inputs and outputs electrically alter the coil configuration to obtain a selected one of two possible inductances.

The inductor unit is contained within a cryostat filled with liquid nitrogen and connect/disconnect switches are provided at the input and output to electrically and thermally disconnect the unit.

BRIEF DESCRIPTION OF THE DRAWINGS

FIG. 7 illustrates two of a plurality of coil assemblies in relationship to a base member;

FIG. 9 illustrates the windings of an inductor and how the windings are interconnected for one inductance value while

FIG. 10 illustrates the windings of an inductor and how the windings are interconnected for another inductance value while

FIG. 11 illustrates a typical input or output bus bar and its connection to a coil assembly;

FIG. 12 illustrates a typical coil bus bar and its connection to a coil assembly;

DESCRIPTION OF THE PREFERRED EMBODIMENT

Figure 1:
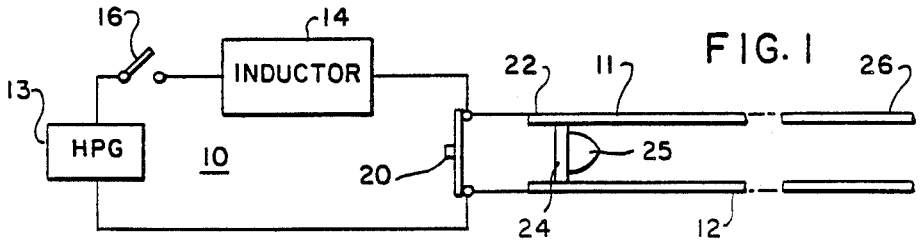
FIG. 1 is a simplified presentation of an electromagnetic launcher.

Referring now to FIG. 1, there is illustrated, in simplified form, an electromagnetic launcher system in which the present invention finds application. The arrangement includes a power supply 10 for supplying a high DC current to parallel electromagnetic launcher rails 11 and 12. The power supply includes a homopolar generator 13 which, when driven to a predetermined rotational speed, all or a fraction of the kinetic energy thereof is transferred to a storage inductor 14 when switch 16 is closed. The arrangement enables relatively lower power input to build up and store a large quantity of pulse power by storing the energy first in a rotating mass and then in an electromagnetic field.

During the charging cycle, switch 20 connected to the breach end 22 of the rails remains in a closed condition. When the inductor current magnitude reaches an appropriate firing level, switch 20 is opened and current is commutated into rails 11 and 12 bridged by movable conducting armature 24. Current flows down one rail through the armature and back along the other rail such that the current flowing in the loop exerts a force on the armature 24 to accelerate a projectile 25 to a desired velocity. The accelerating force in essence is a function of the magnetic flux density and current density, and since the current flowing in the rails is in the megamp range, the projectile 25 exits the muzzle end 26 of the rail system at an exceptionally high velocity measurable in many kilometers per second.

The inductor 14 must be designed to present a very low ohmic impedance so as to allow for an extremely large inductive energy storage capacity at a relatively low charging voltage.

Figure 2:
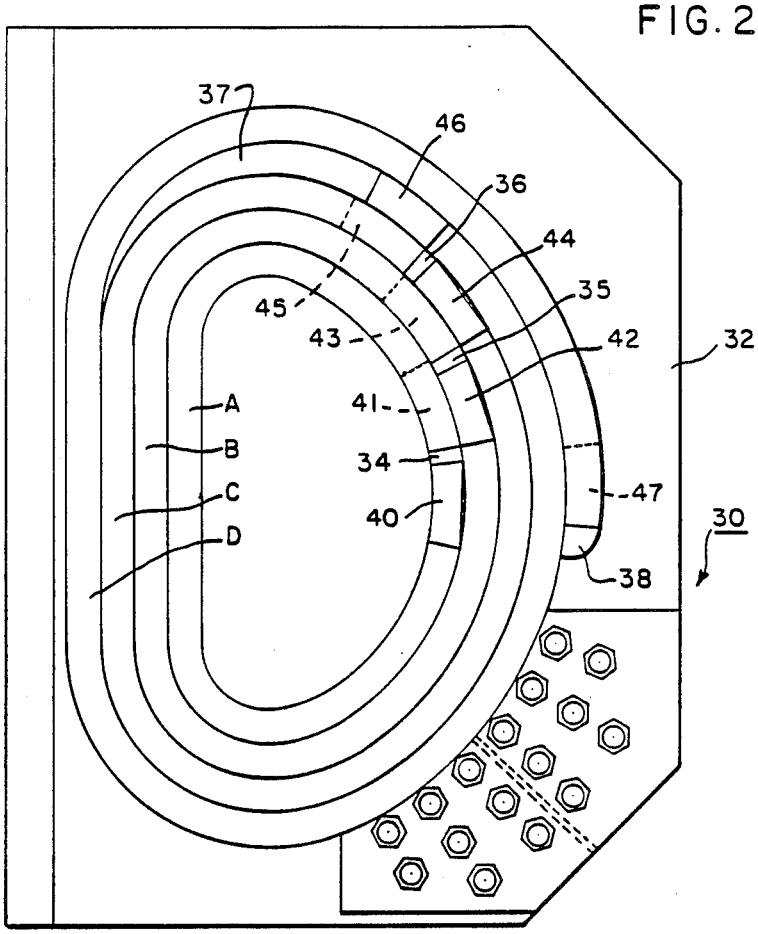
FIG. 2 is a view of one of a plurality of coil assemblies.

The inductor of the present invention is made up of a plurality of coil assemblies, one of which is illustrated in FIG. 2. A typical coil assembly, designated by the numeral 30, includes a plurality of individually insulated electrical conductors A, B, C and D collectively nested in a shaped aperture of structural support plate 32.

With additional reference to FIGS. 3A through 3D, it is seen that the individual conductors are of progressively increasing size and are essentially D-shaped so as to maintain constant tension during operation in order to maximize structural efficiency. Conductors A, B, and C have respective first and second ends which are positioned opposite one another whereas in conductor D, an overlapping relationship is presented.

In order to prevent movement of the conductors during operation, spacer members 34, 35 and 36 are placed between the ends of conductors A, B and C, respectively. A crescent-shape spacer member 37 abuts one end of coil D and is positioned in the space between coil C and D, and a spacer member 38 abuts the other end of coil D between it and the structural plate 32.

Figure 4:
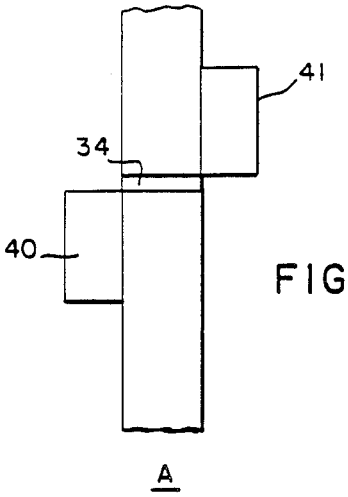
FIG. 4 is a view along line IV—IV of FIG. 3A.

Each of the conductors has a terminal block affixed to the side of the conductor at each end thereof. More specifically, conductor A includes terminal blocks 40 and 41, conductor B includes terminal blocks 42 and 43, conductor C includes terminal blocks 44 and 45 and conductor D includes terminal blocks 46 and 47. Taking conductor A as exemplary, FIG. 4 is a view along line IV—IV in FIG. 3A and illustrates terminal blocks 40 and 41 as being on opposite sides of coil A at first and second ends thereof separated by spacer member 34.

Figure 3D:
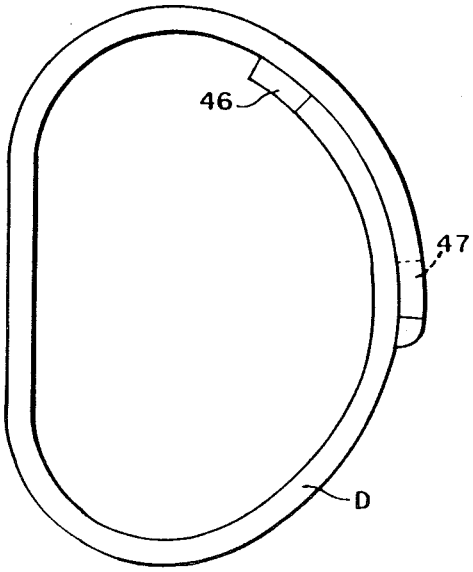
FIGS. 3A and 3D show the individual conductors of the coil assembly of FIG. 2.
Figure 3C:
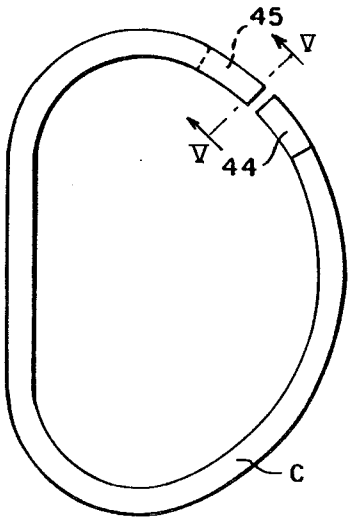
Figure 3B:
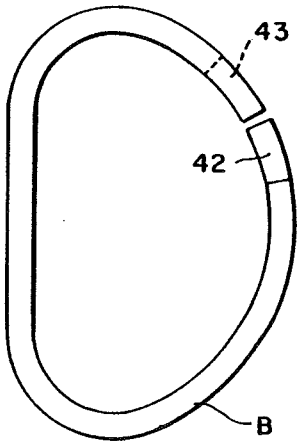
Figure 3A:
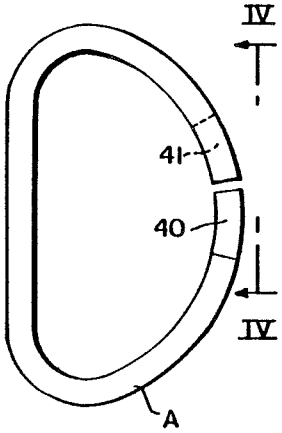
Figure 5:
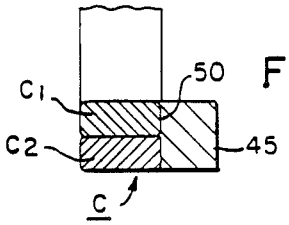
FIG. 5 is a view along line V—V of FIG. 3C.
Figure 5A:
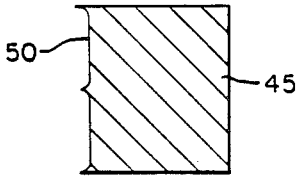
FIG. 5A is a view of the terminal block illustrated in FIG. 5.

Taking coil C as exemplary, FIG. 5 is a view along line V—V of FIG. 3C and illustrates a preferred construction of the conductor and terminal block. In order to increase the current-carrying capability of a conductor, a typical conductor such as illustrated by conductor C in FIG. 5 is made up of two individually-insulated subconductors, C1 and C2. The use of two pieces of copper instead of a single piece also facilitates the bending of the conductor into the D-shape required for minimizing conductor and structural stresses. Terminal block 45 is affixed to the side of the conductor such as by brazing and has an undersurface 50 which is preferably machined to a contour matching that of the adjacent conductor pieces C1 and C2. A view of the terminal block showing the scalloped undersurface is illustrated in FIG. 5A.

Figure 6:
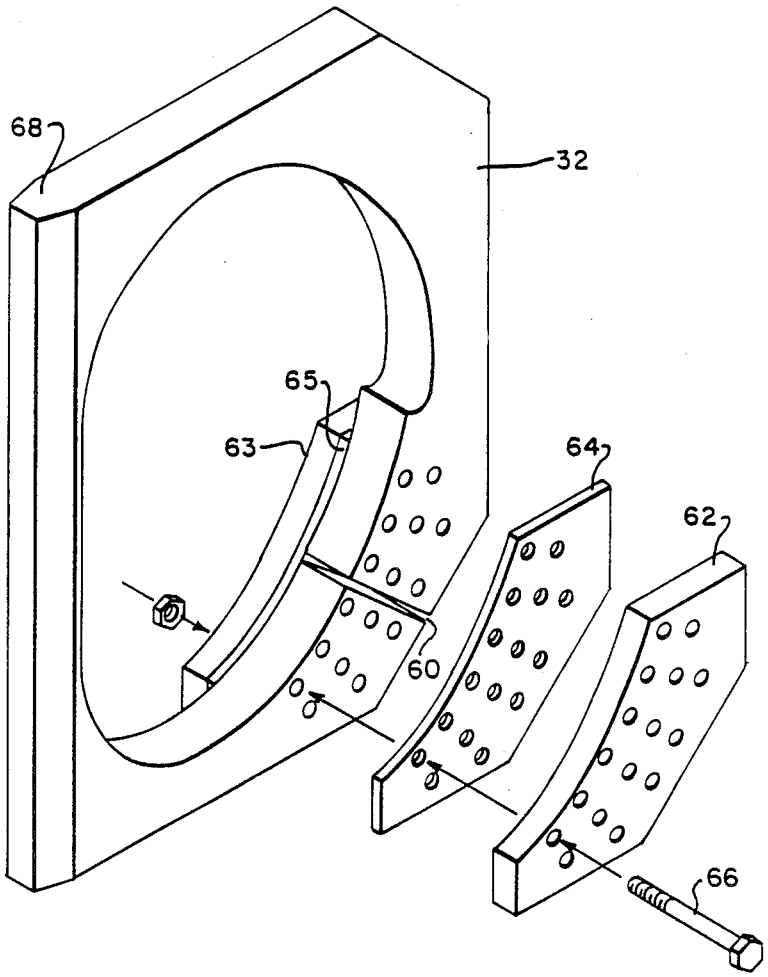
FIG. 6 is a view of the structural support plate portion of the coil assembly of FIG. 2.

A typical structural support plate which surrounds the conductors is further illustrated in FIG. 6. The structural support plate 32, which is of aluminum, is cut through at its lower corner as indicated by numeral 60 so as to minimize any eddy currents in the structure during charging and discharging of the inductor, and which eddy currents would cause unwanted heating and electrical problems.

In order to maintain the structural integrity of the cut plate, additional reinforcing plates 62 and 63 are provided and are bolted in place with intervening insulating plates 64 and 65 to prevent electrical contact of the reinforcing plates 62 and 63 with the structural plate 32. The bolts 66 are insulated from the structural plate to prevent electrical contact.

As will be described, the individual coil assemblies are arranged in a circular array and for this purpose, as indicated by numeral 68, the edge of the plate has a double taper which abuts against the tapers of adjacent plates to aid in self-alignment when the inductor is assembled.

As part of the assembly, and as indicated in FIG. 7, a base plate 70 is provided and includes means for positioning and retaining the individual coil assemblies. To accomplish this, in one embodiment, base plate 70 includes a plurality of grooves 72 each being of a size to accommodate a respective coil assembly, two of which are illustrated. A central rod 74 extends along the longitudinal central axis Z of the base plate and facilitates in lifting operations.

Figure 8:
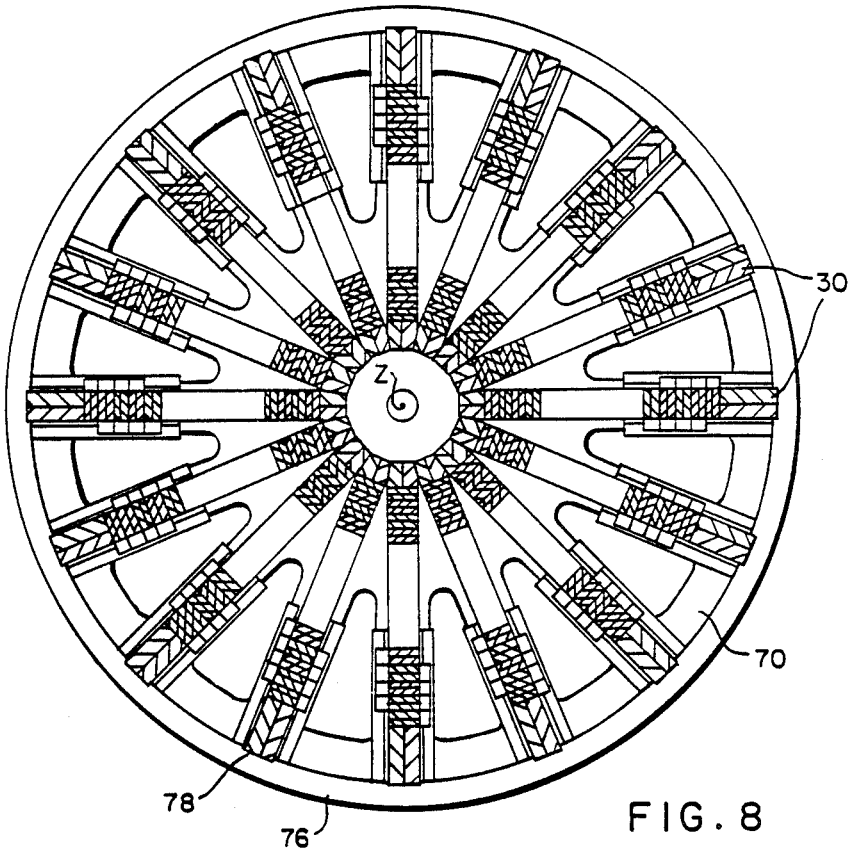
FIG. 8 is a plan view of the coil assemblies shown in sections, supported by the base plate.

For purposes of illustration, let it be assumed that a typical inductor would include 16 coil assemblies each constituting a single turn of the inductor. A plan view of such arrangement is illustrated in FIG. 8 wherein 16 coil assemblies 30 are disposed in a circle symmetrically about the longitudinal central axis Z. FIG. 8 illustrates the abutting double taper edges of the coil assemblies as they are positioned in base plate 70. To further aid in maintaining the proper positional orientation, there is provided an insulated alignment ring 76 having notches 78 to receive and confine the outer edge of a respective one of the coil assemblies.

Figure 9:
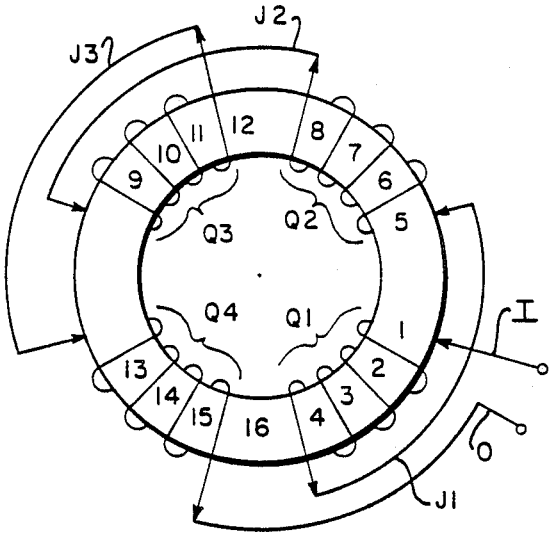
Figure 9A:
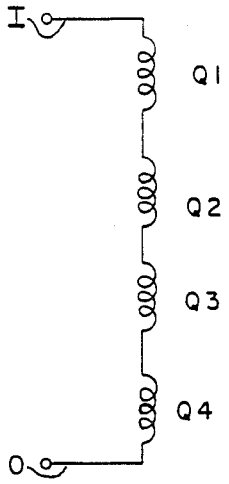
FIG. 9A is an electrical schematic of the connection.

All of the individual coils of the arrangement of FIG. 8 can be electrically connected in series to result in an inductor having a single inductance value. In accordance with a preferred embodiment of the present invention, two values of inductance may be selected, the higher one operable at lower current levels for rapid fire electromagnetic launcher operation, and the lower one operable at higher currents for single shot operation. FIG. 9 is an electrical schematic representation of the inductor in the configuration utilized for the high inductance value. The totality of turns is divided into four quadrants Q1, Q2, Q3 and Q4, each quadrant being comprised of four turns, for a total of 16 turns. With the higher inductance value, the quadrants are connected in series as illustrated in FIG. 9A.

In FIG. 9, the input lead I is connected to the first coil of quadrant Q1, the last coil of which is connected to the first coil of quadrant Q2 by means of jumper J1. The last coil of quadrant Q2 is connected to the first coil of quadrant Q3 by jumper J2 while jumper J3 connects quadrant Q3 with quadrant Q4, the last turn of which is connected to output O.

Figure 10:
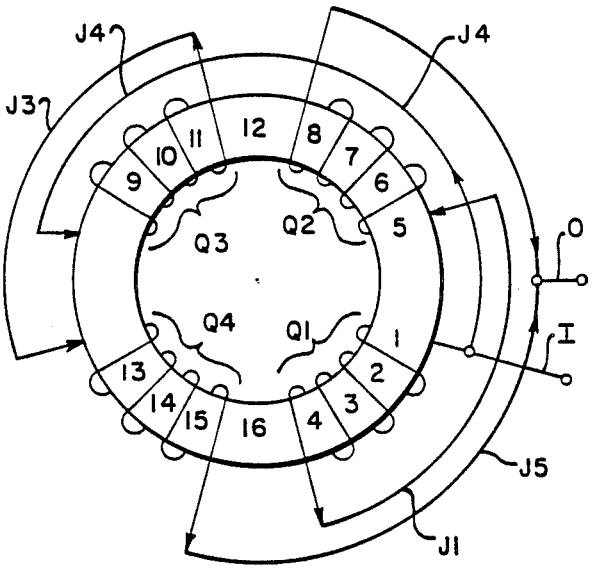
Figure 10A:
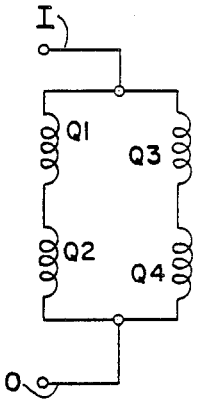
FIG. 10A is an electrical schematic of the connection.

For the lower inductance value, as illustrated in FIG. 10, input I is connected, as before, to quadrant Q1 and is additionally connected to quadrant Q3 by means of jumper J4. Quadrant Q3 is connected in series with quadrant Q4, as in FIG. 9, with quadrants Q2 and Q4 being both electrically connected together and to output O by means of jumper J5. The serial/parallel arrangement of quadrants is as illustrated in FIG. 10A. Although four quadrants have been shown by way of example, a greater or lesser number of sectors may be utilized.

In order to make the input/output connections as well as the jumper connections from quadrant to quadrant, the coil assemblies at the beginning and end of each quadrant are provided with coil bus bars as illustrated in FIGS. 11 and 12. FIG. 11 illustrates a typical input or output bus bar 90 which has a vertical portion 91 as well as a horizontal portion 92, with the vertical portion being electrically connected to all of the conductors A, B, C and D of coil assembly 30. The connection is made to their respective terminal blocks such as by bolts, in which case, the terminal blocks would have threaded holes horizontally oriented. The horizontal portion 92 includes at the end thereof an aperture 94 for receiving a connect/disconnect switch.

A typical coil bus bar 96 is illustrated in FIG. 12 and likewise includes a vertical portion 97 as well as a horizontal portion 98, with the vertical portion being connected to all of the terminal blocks on one side of the coil assembly 30. Depending upon the coil assembly's position in the array, the vertical portion of the coil bus bar may be affixed to the terminals on the other side of coil assembly 30 in which case, the horizontal portion 98 would extend toward the viewer as opposed to away from the viewer as in FIG. 12.

Figure 13:
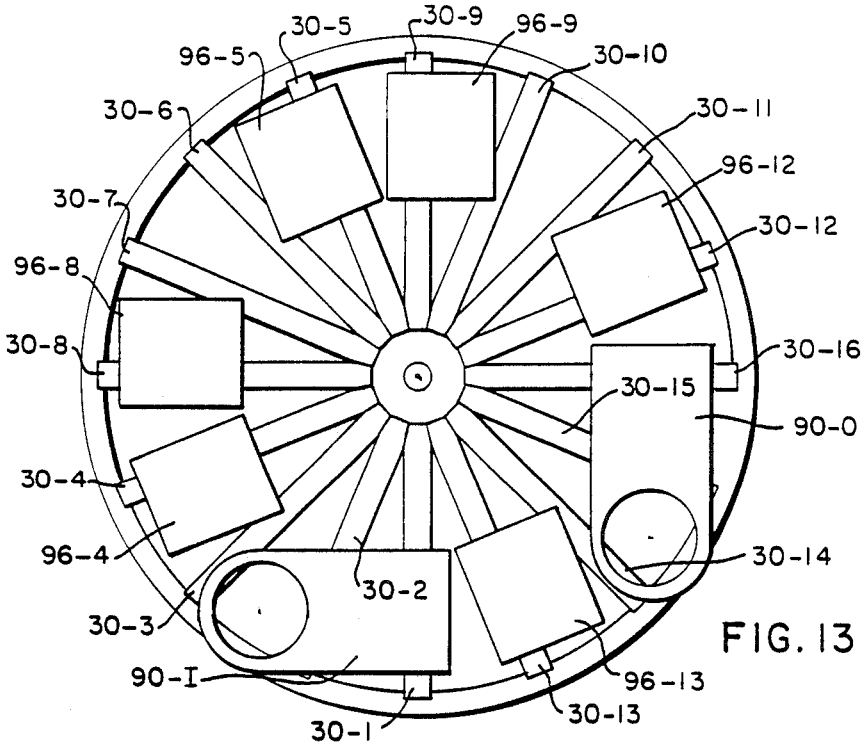
FIG. 13 is a plan view of the coil assemblies with connected bus bars.

FIG. 13 again illustrates a plan view of the coil assemblies 30 together with the appropriate bus bars in order to make the electrical connections as depicted in FIGS. 9 or 10. The coil assemblies 30 have been given respective numbers such that the first quadrant includes coil assemblies 30-1 to 30-4, the second quadrant includes coil assemblies 30-5 to 30-8, the third quadrant includes coil assemblies 30-9 to 30-12 and the fourth quadrant includes coil assemblies 30-13 to 30-16. An input bus bar is connected to coil assembly 30-1 and is designated 90-I (input) while an output bus bar is connected to coil assembly 30-16 and is designated 90-0 (output). The remaining coil assemblies at the beginning and end of each quadrant include a coil bus bar as in FIG. 12, some of which are at the beginning of a quadrant (coil bus bars 96-5, 96-9 and 96-13) while others are connected to the coil assembly at the end of a quadrant (96-4, 96-8, and 96-12).

Figure 14A:
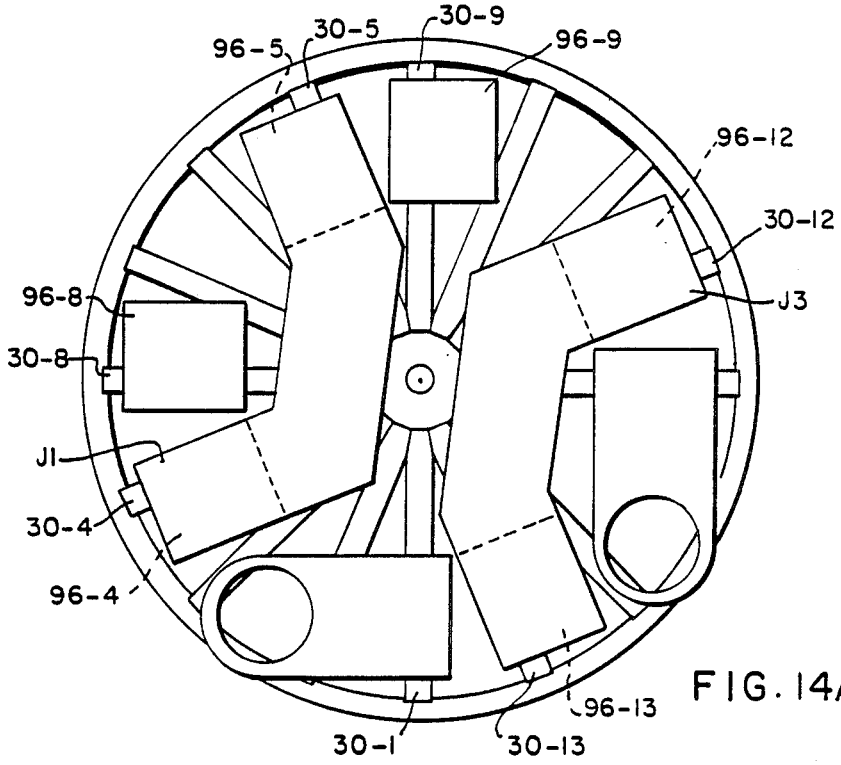
FIGS. 14A and 14B illustrate jumper bus bar connections in order to achieve one value of inductance.
Figure 14B:
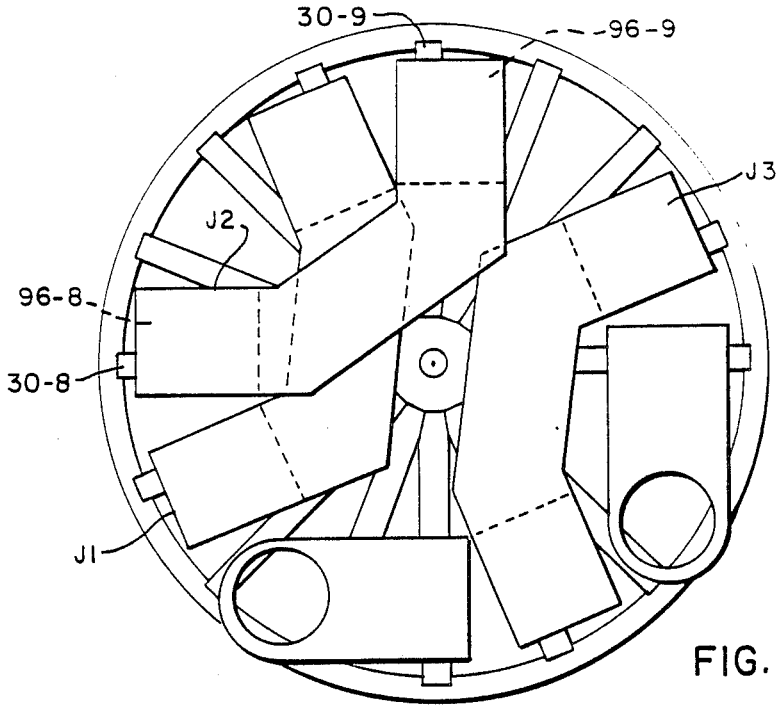

The electrical connections to implement the higher inductance configuration depicted in FIG. 9 is illustrated in FIGS. 14A and 14B. In FIG. 14A, jumper J1 makes electrical contact with the horizontal portions of coil bus bars 96-4 and 96-5 thereby electrically joining the last coil of quadrant 1 with the first coil of quadrant 2. In an actual construction, jumper J1 (as well as the other jumpers) would be constituted by a thick copper plate affixed to the horizontal portions of the coil bus bars such as by means of heavy duty bolts (not illustrated).

In a similar fashion, jumper J3 affixed to the horizontal portions of coil bus bars 96-12 and 96-13 connects the last coil of quadrant Q3 with the first coil of quadrant Q4. The horizontal portions of coil bus bars 96-8 and 96-9 are located at a higher horizontal level than those connected to jumpers J1 and J3 in order to receive jumper J2, as illustrated in FIG. 14B, thus completing the configuration illustrated electrically in FIG. 9.

Figure 15A:
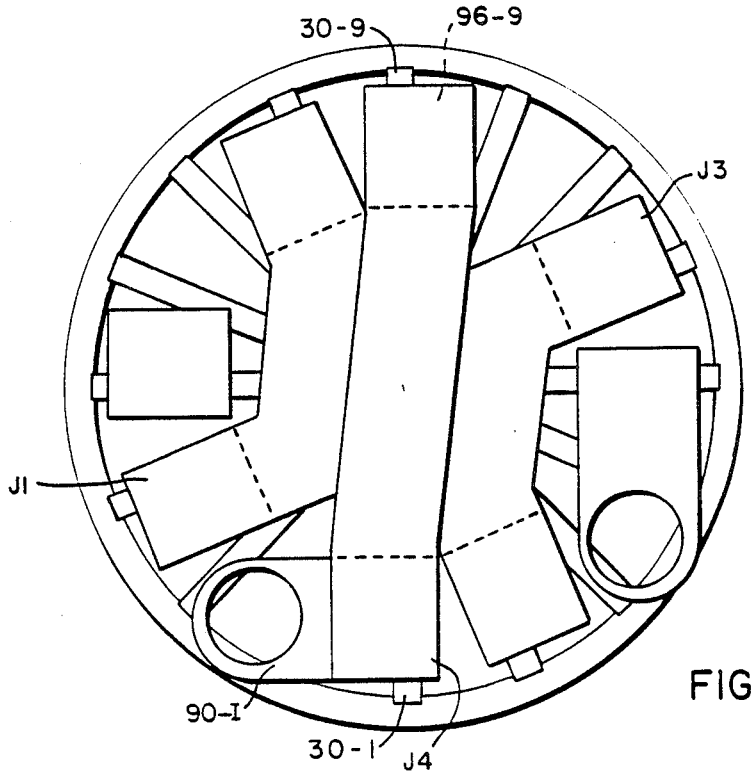
FIGS. 15A and 15B illustrate jumper bus bar connections in order to achieve another value of inductance.
Figure 15B:
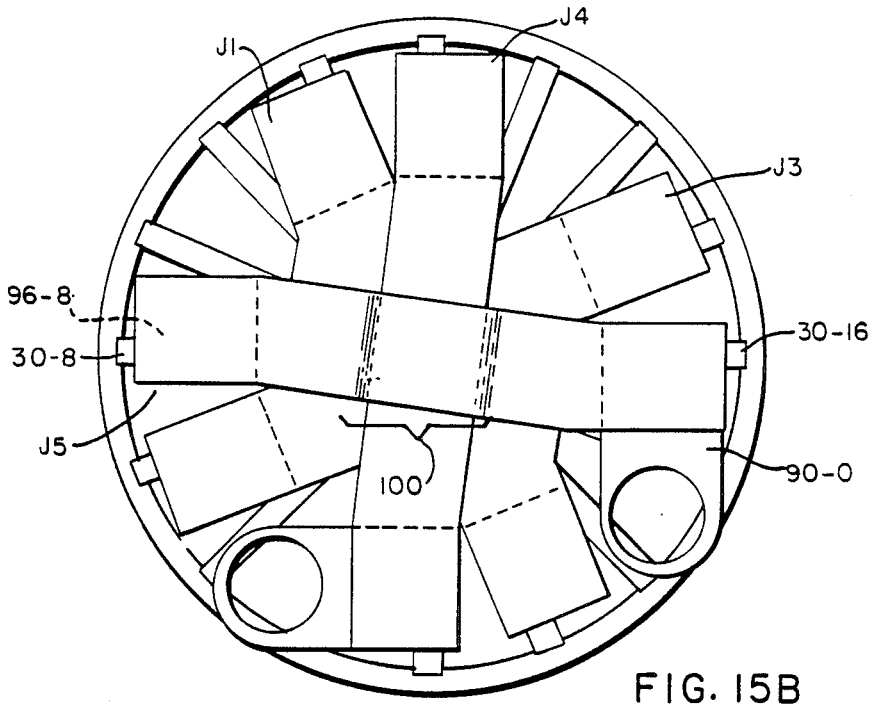

For the lower inductance configuration illustrated in FIG. 10, jumper J2 is removed and jumper J4 is added and connected to bus bars 96-9 and 90-I as illustrated in FIG. 15A. The restructuring is completed with the addition of jumper J5, as illustrated in FIG. 15B connecting coil bus bar 96-8 with the output bus bar 90-0. Due to the higher elevation of jumper J4, jumper J5 would have a raised portion 100 to straddle jumper J4.

The 16 coil assemblies arranged in a circular array are interconnected to form a toroidal inductor. Each coil assembly has four conductors which progressively increase in size with conductor A having the shortest path length and conductor D having the longest path length. A greater level of current would normally be carried by the shortest conductor, conductor A, during both steady state and transient conditions. The most effective utilization of the coil mass occurs when each conductor carries equivalent current to ensure for minimum losses. This is accomplished in the present invention by an external transposition scheme which equalizes the current paths.

Figure 16:
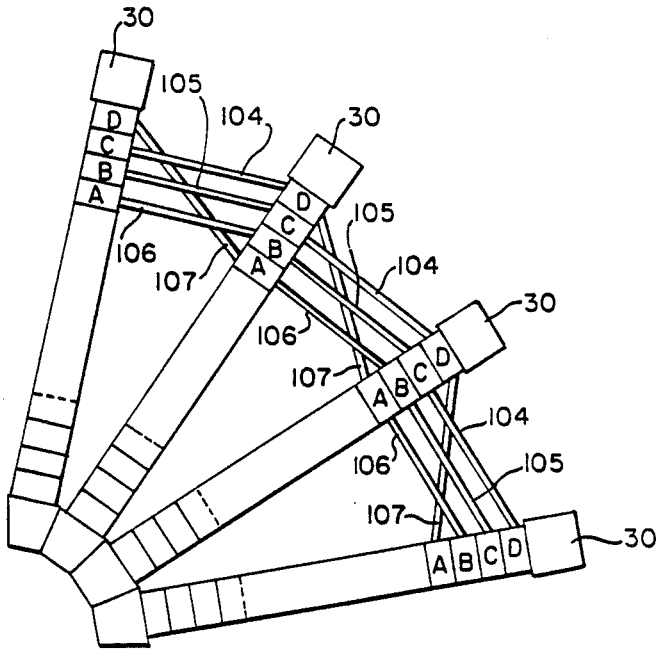
FIG. 16 is an electrical schematic illustrating the transposition of conductors.

A schematic of the external transposition is illustrated in FIG. 16 for one quadrant of four coil assemblies 30. It is seen that with the provision of transposition jumper 104, conductor D is connected with conductor C of the next coil assembly. Transposition jumper 105 connects conductor C with conductor B, transposition jumper 106 connects conductor B with conductor A and transposition jumper 107 connects conductor A with conductor D. Thus, it is seen that current entering the particular quadrant will flow equally in all four conductors A, B, C and D.

Figure 17:
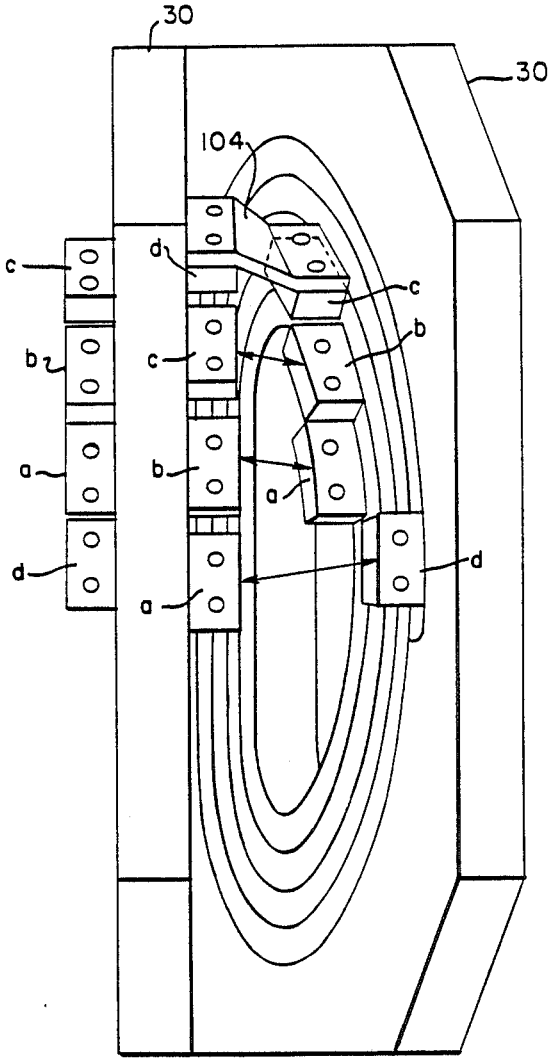
FIG. 17 is a view of two adjacent coil assemblies showing the transposition method.
Figure 18A:
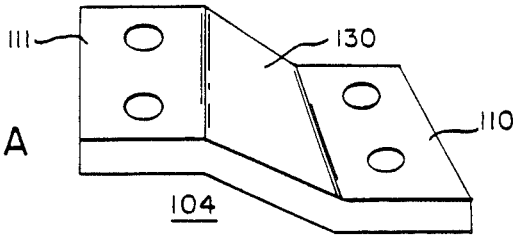
FIGS. 18A through 18D illustrate preferred transposition jumper members.
Figure 18B:
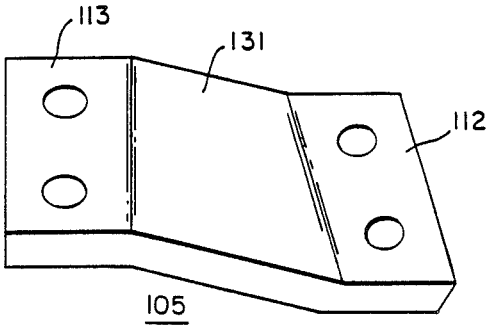
Figure 18C:
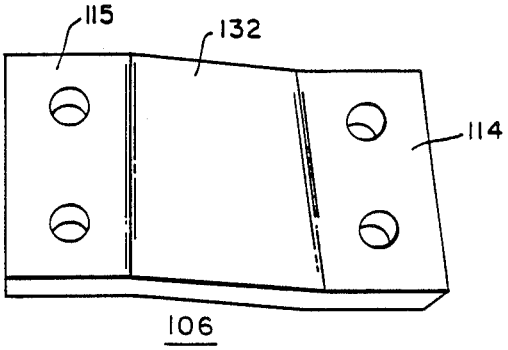
Figure 18D:
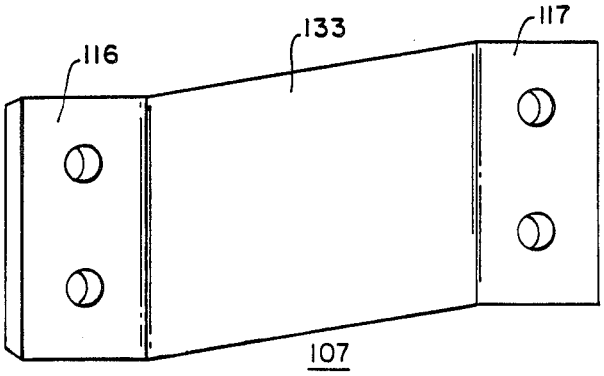

FIG. 17 is a view of two adjacent coil assemblies 30 with the visible terminal blocks being given a lower case letter designation indicative of the conductor to which they are connected. In one embodiment, the transposition jumpers may be fabricated from short sections of flexible copper braid. However, where space allotment is limited, a solid copper jumper is preferred, as illustrated by a transposition jumper 104 in FIG. 17. The remaining jumpers have been omitted for clarity but would connect the terminal blocks as illustrated by the double ended arrows.

The four different transposition jumpers necessary to make the interconnections are illustrated in FIGS. 18A through 18D. Each of the jumpers include two flat segments 110, 111 for jumper 104; 112, 113 for jumper 105; 114, 115 for jumper 106; and 116, 117 for jumper 107. These flat segments match the top of the respective terminal blocks whereby physical and electrical connection may be accomplished by means of bolts through the holes illustrated. The flat segments of a jumper are at different elevations with respect to one another and are joined by a central segment 130 for jumper 104; 131 for jumper 105; 132 for jumper 106; and 133 for jumper 107. It is seen that with increasing size, there is a progressive decrease in the angle between the edges of the flat segments, with the edges of segments 116 and 117 being nearly parallel. The four jumpers illustrated in FIGS. 18A through 18D are duplicated in another quadrant while the remaining two quadrants would have jumpers which are the mirror image of those illustrated.

In order to achieve a high inductance-to-resistance ratio and to minimize size and weight, cryogenic cooling is preferably provided for the inductor unit since at cryogenic temperatures, resistance losses can be reduced by factors of 10 to 10,000. The cooling medium for this purpose may be liquid nitrogen in view of its ready availability, low cost, superior dielectric properties and general overall safety.

Figure 19:
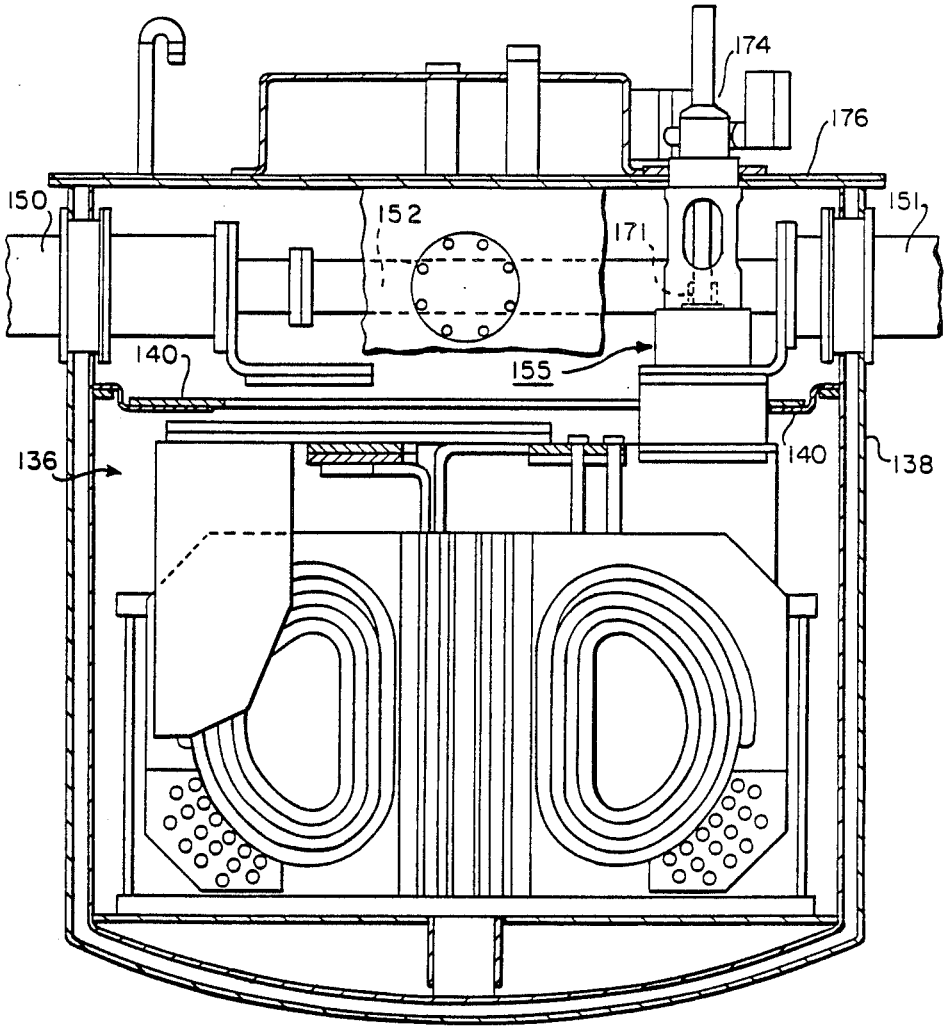
FIG. 19 is a view of the inductor assembly as placed in a cryostat container for operation at cryogenic temperatures.

The assembled inductor unit designated by the numeral 136 is illustrated in FIG. 19 as being contained within a double walled cryostat container 138 having a vacuum and insulation between its walls. The cryostat container minimizes thermal heat leakage and reduces the amount of liquid nitrogen required for operation.

If during the filling process, liquid nitrogen is poured directly into the cryostat container, the bottom of the inductor unit would immediately become cold while the top of the unit would be at room temperature thereby leading to undesired thermal stresses. In order to minimize these thermal stresses, a tray 140 is provided and extends partially around the inside of the cryostat container 138 to serve as a shelf upon which the liquid nitrogen is initially poured. Upon contact with the shelf, the liquid nitrogen vaporizes thereby uniformly cooling the inductor by convection. After a predetermined temperature drop of the whole unit, the liquid nitrogen fill rate may be increased so that the liquid actually flows over the edge of tray 140.

During the cool-down operation, the aluminum structural support plate of a coil assembly will have greater thermal contraction than that of the copper conductors which will accordingly be placed into compression such that when the inductor is operated, the maximum tensile strain in the copper conductors will be reduced.

FIG. 19 further illustrates the input and output leads 150 and 151 entering and exiting at the top of the cryostat container and coaxially arranged about return lead 152 from the load device.

Figure 20:
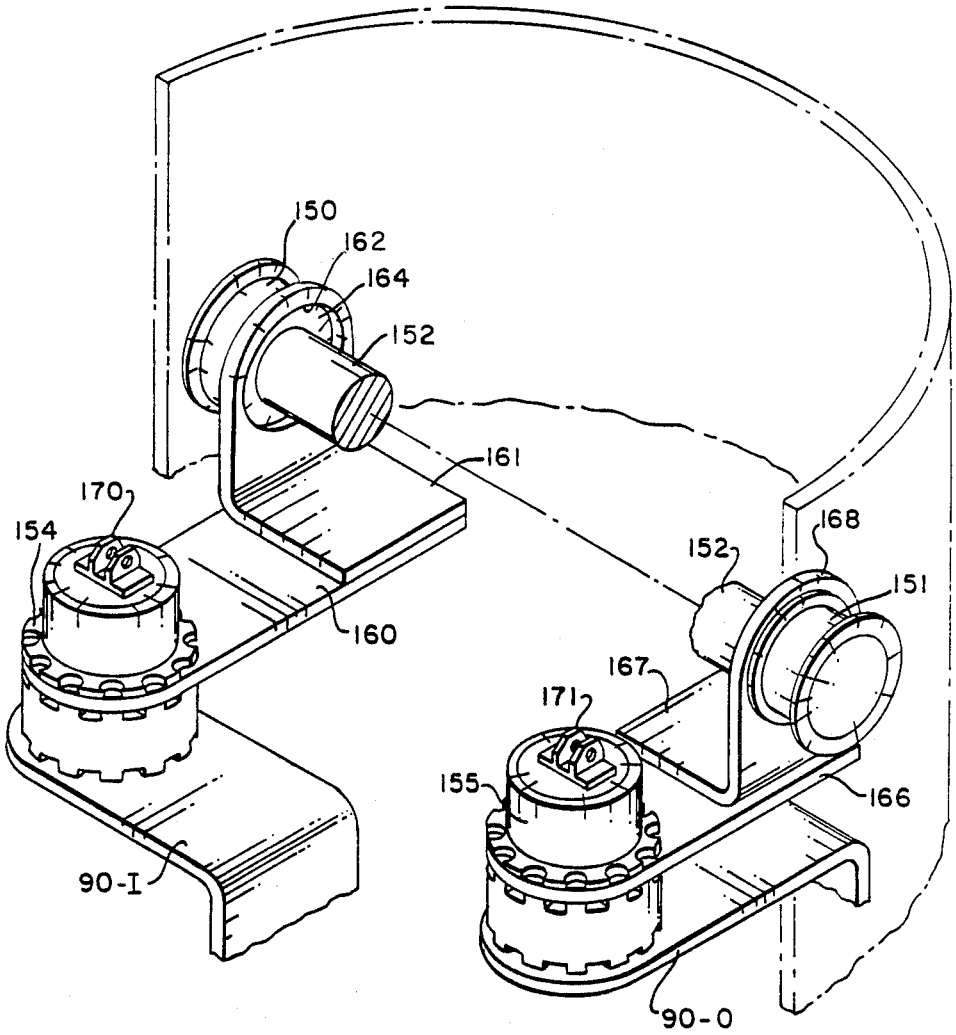
FIG. 20 is an isometric view of the input and output connections for the arrangement of FIG. 19.

With additional reference to FIG. 20, electrical connection from the input and output leads 150 and 151 are made to the inductor unit 136 by way of connect/disconnect switches 154 and 155 details of which form the subject matter of copending application Ser. No. 943,015, filed 12-18-86 and assigned to the same assignee as the present invention.

Switch 154 (not shown in the elevational view of FIG. 19) electrically connects the input bus bar 90-I (FIG. 13) with the input lead 150 via conductor bus bars 160 and 161, with conductor bus bar 161 being L-shaped and including an aperture 162 for passage of return lead 152 and being electrically connected to flange 164 of input lead 150.

In a similar fashion, switch 155 connects output bus bar 90-0 with the output lead 151 by means of conductor bus bars 166 and 167, with this latter L-shaped bus bar being electrically connected to flange 168 of output lead 151.

Switches 154 and 155 include respective coupling devices 170 and 171 for connection to an actuating mechanism, one of which, 174, is illustrated as being mounted on the cryostat cover 176 in FIG. 19.

Figure 21:
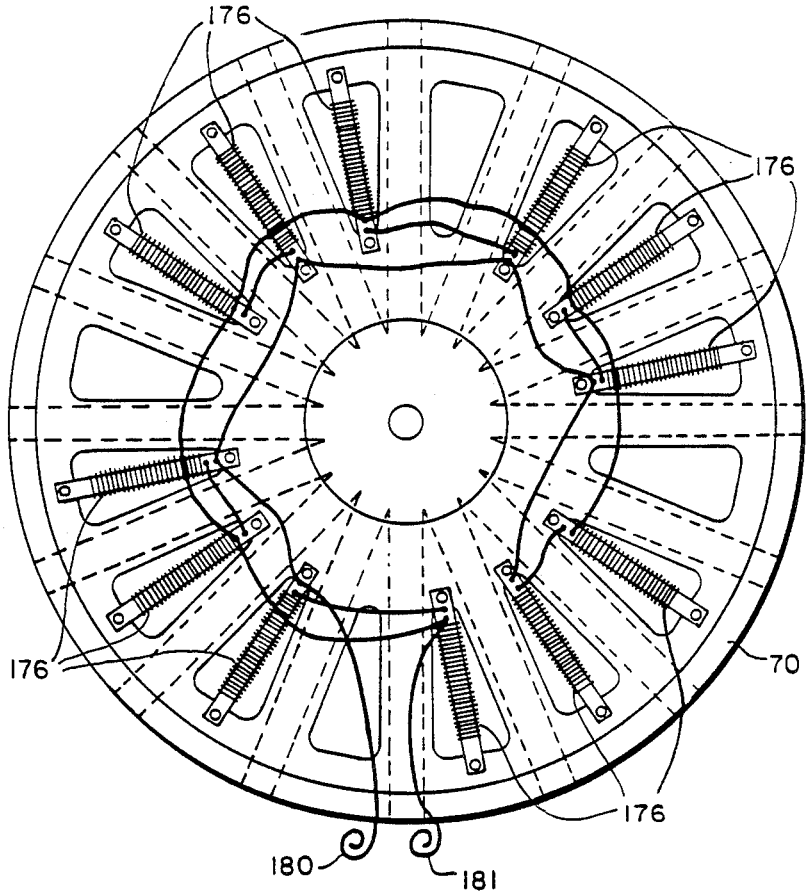
FIG. 21 illustrates a heating arrangement which may be utilized herein.

After the inductor has been placed into service if it is desired to change the inductance value thereof, or if routine maintenance is to be performed, the liquid nitrogen within the cryostat container must be drained. Work on the inductor, however, cannot be commenced until the component parts have warmed up to room temperature, a condition which, starting at cryogenic temperatures, may take days or even weeks to attain. Accordingly, heating means are provided in order to speed up the warming process. FIG. 21 illustrates one arrangement which includes a plurality of heaters 176 mounted on the undersurface of base plate 70 as illustrated. Heater leads 180 and 181, along with leads from any other instrumentation such as thermal sensors, may be brought out of the cryostat container via an instrumentation port.

We claim:

1. A high energy, low resistance inductor comprising:
(A) a plurality of coil assemblies;
(B) each said coil assembly including
  (i) a group of nested conductors;
  (ii) a structural plate having a central shaped aperture, said nested conductors being contained within said aperture;
(C) said coil assemblies being radially arranged with respect to a central longitudinal axis; and
(D) means for making electrical connections with and between said conductors.

2. Apparatus according to claim 1 wherein:
(A) each said conductor is comprised of at least two subconductors insulated from one another.

3. Apparatus according to claim 1 wherein:
(A) each said conductor includes first and second terminal blocks;
(B) said first terminal block being connected to one edge of a conductor near one end thereof;
(C) said second terminal block being connected to an opposite edge of a conductor near the other end thereof.

4. Apparatus according to claim 3 wherein:
(A) said first and second terminal blocks extend laterally past the side surfaces of said structural plate.

5. Apparatus according to claim 1 wherein:
(A) each of said conductors is bent into an essentially D shape.

6. Apparatus according to claim 5 wherein:
(A) at least one of said conductors has first and second end portions which overlap.

7. Apparatus according to claim 6 wherein:
(A) each of the remaining ones of said conductors has first and second ends which face one another.

8. Apparatus according to claim 1 which includes:
(A) spacer means abutting said first and second ends of said remaining conductors.

9. Apparatus according to claim 3 wherein:
(A) the undersurface of each of said terminal blocks is contoured to match the edge surface of the conductor to which it is connected.

10. Apparatus according to claim 1 which includes:
(A) a base member;
(B) said coil assemblies being positioned on said base member.

11. Apparatus according to claim 10 wherein:
(A) said base member includes means for positioning and retaining said coil assemblies.

12. Apparatus according to claim 11 wherein:
(A) said means for positioning and retaining includes a plurality of radial grooves defined in said base member.

13. Apparatus according to claim 10 which includes:
(A) a retaining ring surrounding and contacting said radially arranged coil assemblies.

14. Apparatus according to claim 13 wherein:
(A) said retaining ring includes a plurality of notches to receive the respective edges of said structural plates of said coil assemblies.
15. Apparatus according to claim 10 which includes:
(A) a lifting bar connected to said base member and extending along said central longitudinal axis.
16. Apparatus according to claim 1 wherein:
(A) each of said structural plates is of metal and includes a cut completely therethrough to minimize eddy currents in said plate during operation.
17. Apparatus according to claim 16 which includes:
(A) reinforcing plates connected on opposite surfaces of said structural plate and straddling said cut.
18. Apparatus according to claim 17 wherein:
(A) said reinforcing plates are also of metal, and which further includes
(B) insulating plates positioned between said reinforcing plates and said structural plate.
19. Apparatus according to claim 18 wherein:
(A) said reinforcing plates are connected by means of a plurality of insulated bolts.
20. Apparatus according to claim 1 wherein:
(A) said radially arranged coil assemblies are divided into a plurality of sectors each including an input and output bus bar.
21. Apparatus according to claim 20 wherein:
(A) said conductors of said coil assemblies of a sector being electrically connected such that each conductor of one coil assembly is electrically connected to a different sized conductor of an adjacent coil assembly.
22. Apparatus according to claim 21 wherein:
(A) the electrical connection between a conductor of one coil assembly and a conductor of an adjacent coil assembly is by means of a solid copper, shaped block.
23. Apparatus according to claim 22 wherein:
(A) each said shaped block includes two end segments joined by a central angled segment, said end segments being at different elevations.
24. Apparatus according to claim 23 wherein:
(A) said connection is via a terminal block.
25. Apparatus according to claim 20 which includes:
(A) a plurality of electrically conducting jumper plates connecting selected ones of said input and output bus bars.
26. Apparatus according to claim 25 wherein:
(A) said coil assemblies are connected in series.
27. Apparatus according to claim 20 wherein:
(A) said coil assemblies are divided into four quadrants.
28. Apparatus according to claim 27 which includes:
(A) a plurality of electrically conducting jumper plates connecting selected ones of said input and output bus bars.
29. Apparatus according to claim 28 wherein:
(A) said coil assemblies are connected into two parallel branches each including two coil assemblies in series.
30. Apparatus according to claim 20 wherein:
(A) each said bus bar extends vertically from the side of a coil assembly and includes a horizontally disposed upper portion.
31. Apparatus according to claim 30 wherein:
(A) at least two of said bus bars includes horizontally disposed upper portions at a different height than the upper portions of remainder of said bus bars.
32. Apparatus according to claim 10 which includes:
(A) a liquid gas filled cryostat;
(B) said coil assemblies being immersed in said liquid gas.
33. Apparatus according to claim 32 wherein:
(A) said cryostat includes a tray at the upper end thereof for initially receiving said liquid gas.
34. Apparatus according to claim 32 which includes:
(A) a plurality of heaters contained within said cryostat;
(B) said heaters being energized after said liquid gas is drained from said cryostat, for servicing or otherwise.
35. Apparatus according to claim 34 wherein:
(A) said heaters are mounted on said base member.
36. Apparatus according to claim 32 wherein:
(A) said conductors are of copper; and
(B) said structural plate is of aluminum.

* * * * *